US009216432B2

(12) United States Patent
Lea et al.

(10) Patent No.: US 9,216,432 B2
(45) Date of Patent: Dec. 22, 2015

(54) METHODS AND APPARATUS FOR DISTRIBUTING WATER IN A SHOWER ENCLOSURE

(71) Applicants: Larry M Lea, Rahway, NJ (US); Larry L. Lea, Old Bridge, NJ (US)

(72) Inventors: Larry M Lea, Rahway, NJ (US); Larry L. Lea, Old Bridge, NJ (US)

( * ) Notice: Subject to any disclaimer, the term of this patent is extended or adjusted under 35 U.S.C. 154(b) by 526 days.

(21) Appl. No.: 13/745,261

(22) Filed: Jan. 18, 2013

(65) Prior Publication Data

US 2013/0186980 A1 Jul. 25, 2013

Related U.S. Application Data

(60) Provisional application No. 61/589,945, filed on Jan. 24, 2012.

(51) Int. Cl.

| | |
|---|---|
| ***B05B 15/06*** | (2006.01) |
| ***E03C 1/04*** | (2006.01) |
| *B05B 1/18* | (2006.01) |
| *B05B 1/20* | (2006.01) |

(52) U.S. Cl.

CPC ..... *B05B 15/069* (2013.01); *E03C 1/0408* (2013.01); *B05B 1/18* (2013.01); *B05B 1/20* (2013.01)

(58) Field of Classification Search

CPC .... B05B 1/185; B05B 15/065; B05B 15/069; E03C 1/0408; E03C 1/06

See application file for complete search history.

(56) References Cited

U.S. PATENT DOCUMENTS

| | | | | |
|---|---|---|---|---|
| 430,253 | A | 6/1890 | Reid | |
| 430,257 | A * | 6/1890 | Taylor | 4/567 |
| 475,754 | A * | 5/1892 | Clifford et al. | 4/567 |
| 819,582 | A * | 5/1906 | Newton | 4/567 |
| 972,589 | A | 10/1910 | Winters | |
| 4,020,796 | A * | 5/1977 | Grifa | 119/671 |
| 4,099,272 | A * | 7/1978 | Sowder | 4/555 |
| 4,545,083 | A | 10/1985 | Searson | |
| 4,554,690 | A | 11/1985 | Knapp et al. | |
| 4,741,289 | A * | 5/1988 | Blose | 119/671 |
| 4,927,083 | A | 5/1990 | Daunt | |
| 5,418,985 | A | 5/1995 | Antione | |
| 5,561,869 | A | 10/1996 | Sarel | |
| 5,909,969 | A | 6/1999 | Davidson | |
| 6,643,862 | B2 | 11/2003 | Aiken | |
| 2006/0242758 | A1 | 11/2006 | Hall | |
| 2010/0242166 | A1 | 9/2010 | Chan | |

* cited by examiner

*Primary Examiner* — Ryan Reis

(74) *Attorney, Agent, or Firm* — James M. Smedley LLC; James Medical Smedley, Esq.

(57) ABSTRACT

Methods and apparatus provide for installation of a water spraying system into an existing shower enclosure, including: a flexible source tube operating to couple to the water feed; a first array for placement proximate to the first wall, and a second array for placement proximate to the third wall, opposite to the first array, each of the first and second arrays having at least two laterally extending, and vertically spaced apart, spray tubes, each spray tube having a series of apertures extending through a wall of the given tube and permitting water to exit the tube and spray into the shower enclosure.

20 Claims, 5 Drawing Sheets

METHODS AND APPARATUS FOR DISTRIBUTING WATER IN A SHOWER ENCLOSURE

CROSS-REFERENCE TO RELATED APPLICATIONS

This application claims the benefit of U.S. Provisional Patent Application No. 61/589,945, filed Jan. 24, 2012, the entire disclosure of which is hereby incorporated by reference.

BACKGROUND OF THE INVENTION

Various embodiments of the present invention relate to methods and/or apparatus for providing a system for modifying a shower enclosure in order to provide expanded sources of water (as compared with a standard shower head) in order to deliver water in such a way as to provide more complete coverage of a user's body when showering.

Various shower arrangements have been proposed heretofore for providing more complete body coverage with shower spray than is afforded by the usual single shower head located in the vicinity of, or above, the user's head.

Some prior art systems provide multi-output shower heads, whereby much of the structure of the system is behind the walls of the shower. These shower systems are installed such that the pipes and fittings of the systems are installed behind the walls with spray spouts being exposed into the shower enclosure. Such in-wall shower systems are associated with a number of drawbacks, including: (i) requiring expertise and specialized consultation for design, installation, and maintenance, which is costly and time-consuming; and (ii) in the case of existing shower enclosures, requiring destruction of substantial portions of the shower enclosure during installation in order to distribute the piping and fittings necessary to achieve an in-wall water supply.

Some prior art arrangements are designed as attachments to a conventional shower enclosure and provide additional shower heads and/or other water exit structures within the shower. These conventional systems, however, do not provide an entirely satisfactory overall spray pattern because they have not taken into consideration the salient physical characteristics of an existing shower enclosure. Some such systems provide additional shower heads at the same vertical level as the existing shower head of the enclosure. Other systems, although providing some shower heads below the vertical level of the existing shower head, require very elaborate, specialized arrangements that require special manufacture and professional skill to install properly.

It has been discovered, however, that with proper thought and design, an easily installed (retrofitting) system may be provided in which substantially full water coverage of the user's body may be achieved.

SUMMARY OF THE INVENTION

In accordance with one or more embodiments of the present invention, an apparatus is provided for installation into an existing shower enclosure, the shower enclosure including a first wall through which a water feed extends, a second wall, and third wall opposite the first wall, thereby forming the enclosure. The apparatus comprises: a flexible source tube operating to couple to the water feed, the source tube having an inside diameter, Ds; a first array for placement proximate to the first wall, and a second array for placement proximate to the third wall, opposite to the first array, each of the first and second arrays having at least two laterally extending, and vertically spaced apart, spray tubes, each spray tube having: (i) a length sufficient to span substantially an entire lateral dimension of the respective first or third wall at which they are disposed, (ii) a series of apertures extending through a wall of the given tube and permitting water to exit the tube and spray into the shower enclosure, and (iii) an inside diameter Di; and a valve system operable to deliver water from the source tube to the respective spray tubes of the first and second arrays, the valve system being operable to adjust respective water flow rates to the first and second arrays. The inside diameter Ds of the flexible source tube may be larger than either of the inside diameters Di of the source tubes of the first and second arrays.

The apparatus may further include a source valve for coupling to the water feed and directing water to either the flexible source tube or to an existing shower head of the shower enclosure in accordance with user selection.

The valve system may include an input port and first and second output ports; the input port may be coupled to, and receives water from, the flexible source tube; the first output port may be coupled to, and provide a user-variable flow of water to, a first intermediate source tube that supplies water to the spray tubes of the first array; and the second output port may be coupled to, and provide a user variable flow of water to, a second intermediate source tube that supplies water to the spray tubes of the second array.

The inside diameter Ds may be about two times larger than the inside diameters Di of at least one of the spray tubes of the first and second arrays. Alternatively or additionally, the inside diameter Ds is about two times larger than the inside diameters Di of at least one of the spray tubes of the first and second arrays. Alternatively or additionally, the inside diameter Di of the spray tubes of the first and second arrays are substantially equal. Alternatively or additionally, the inside diameters of the first and second intermediate source tubes are substantially the same as the inside diameters Di of the spray tubes of the first and second arrays.

The first array may include: at least four laterally extending, and vertically spaced apart, spray tubes; and a vertically oriented distribution tube coupled to one end of each of the four laterally extending spray tubes, each of the spray tubes being terminated at an opposite end thereof, wherein the first intermediate source tube is connected to one of the four spray tubes of the first array. For example, the first intermediate source tube may be connected to an upper-most one of the four spray tubes of the first array. Alternatively or additionally, the first intermediate source tube is connected mid-way along the length of the upper-most one of the four spray tubes.

The second array may include: at least four laterally extending, and vertically spaced apart, spray tubes; and a vertically oriented distribution tube coupled to one end of each of the four laterally extending spray tubes, each of the spray tubes being terminated at an opposite end thereof, wherein the second intermediate source tube is connected to one of the four spray tubes of the second array. For example, the second intermediate source tube is connected to a lower one of the four spray tubes of the second array. Alternatively or additionally, the second intermediate source tube is connected mid-way along the length of the lower one of the four spray tubes.

The apparatus may further include a frame for supporting the first and second arrays within the shower enclosure, the frame comprising: a first grid of support arms for supporting the first array of spray tubes; and a second grid of support arms for supporting the second array of spray tubes; and an interconnecting structure coupled between the first and second grids. The first grid may include: first and second, parallel and spaced apart, vertically extending posts; and a plurality of laterally extending support arms coupled to and extending between the first and second vertically extending posts, wherein each of the spray tubes of the first array is coupled to and extends along a respective one of the laterally extending support arms of the first grid. The second grid may include: first and second, parallel and spaced apart, vertically extending posts; and a plurality of laterally extending support arms coupled to and extending between the first and second vertically extending posts, wherein each of the spray tubes of the second array is coupled to and extends along a respective one of the laterally extending support arms of the second grid.

In accordance with one or more further embodiments, an apparatus for installation into the existing shower enclosure may include: a flexible source tube operating to couple to the water feed; a first array for placement proximate to the first wall, and a second array for placement proximate to the third wall, opposite to the first array, each of the first and second arrays having at least two laterally extending, and vertically spaced apart, spray tubes, each spray tube having: (i) a length spanning at least a portion of the entire lateral dimension of the respective first or third wall at which they are disposed, and (ii) a series of apertures extending through a wall of the given tube and permitting water to exit the tube and spray into the shower enclosure; a water distribution system operable to deliver water from the source tube to the respective spray tubes of the first and second arrays; and a frame for supporting the first and second arrays within the shower enclosure, the frame comprising (i) a first grid of support arms for supporting the first array of spray tubes, and a second grid of support arms for supporting the first array of spray tubes and (ii) an interconnecting structure coupled between the first and second grids.

The water distribution system may include an input port and first and second output ports; the input port is coupled to, and receives water from, the flexible source tube; the first output port is coupled to, and provides water to, a first intermediate source tube that supplies water to the spray tubes of the first array; and the second output port is coupled to, and provides water to, a second intermediate source tube that supplies water to the spray tubes of the second array.

The first array may include: a vertically oriented distribution tube coupled to one end of each of the laterally extending spray tubes, each of the spray tubes being terminated at an opposite end thereof, wherein the first intermediate source tube is connected to one of: (i) the vertically oriented distribution tube of the first array, and (ii) one of the spray tubes of the first array. Preferably, the first intermediate source tube is connected mid-way along the length of an upper-most one of the laterally extending spray tubes.

The second array may include: a vertically oriented distribution tube coupled to one end of each of the laterally extending spray tubes, each of the spray tubes being terminated at an opposite end thereof, wherein the second intermediate source tube is connected to one of: (i) the vertically oriented distribution tube of the second array, and (ii) one of the spray tubes of the second array. Preferably, the second intermediate source tube is connected mid-way along the length of a lower one of the laterally extending spray tubes.

Other aspects, features, and advantages of the present invention will be apparent to one skilled in the art from the description herein taken in conjunction with the accompanying drawings.

DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE PREFERRED EMBODIMENTS

Figure 1:
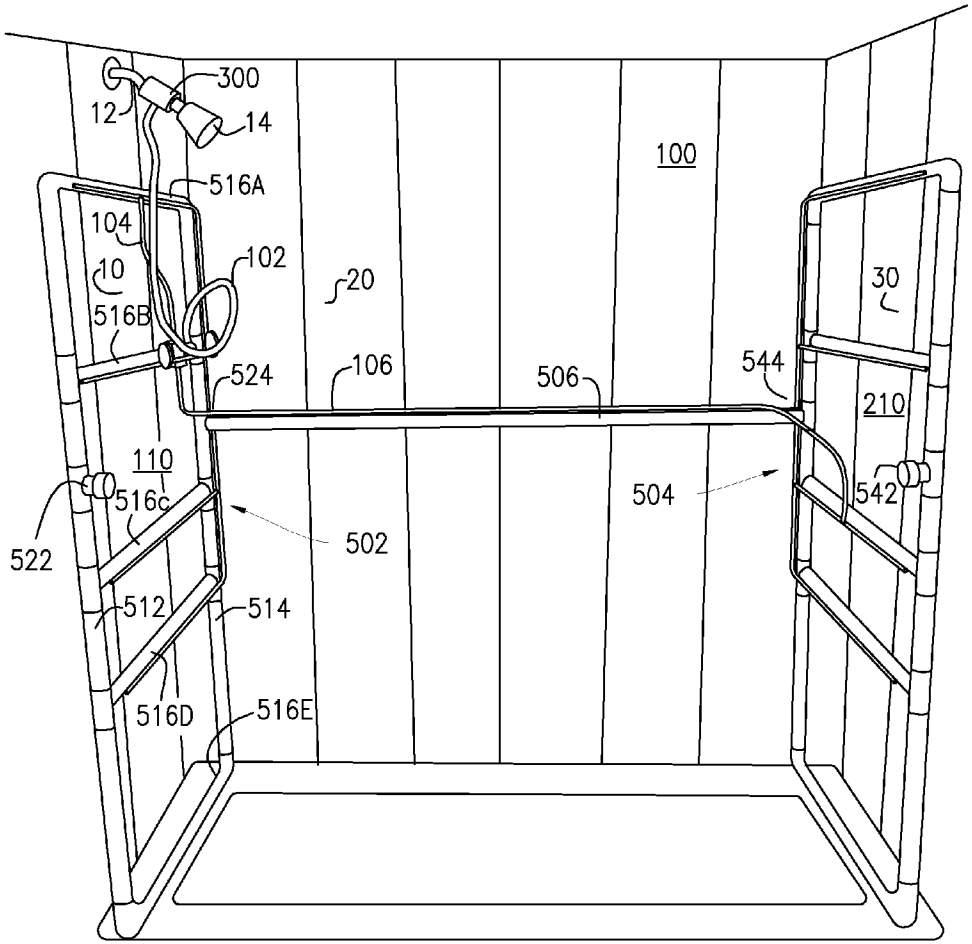
FIG. 1 is a perspective view of an apparatus for installation into an existing shower enclosure in accordance with one or more embodiments of the present invention.

With reference to the drawings wherein like numerals indicate like elements there is shown in FIG. 1 an apparatus 100 for installation into an existing shower enclosure. The shower enclosure includes a first wall 10 through which a water feed 12 extends, a second wall 20, and third wall 30 opposite the first wall 10, thereby forming the enclosure.

The system 100 includes a first array 110 for placement proximate to the first wall 10, and a second array 210 for placement proximate to the third wall 30, opposite to the first array 110.

Figure 2:
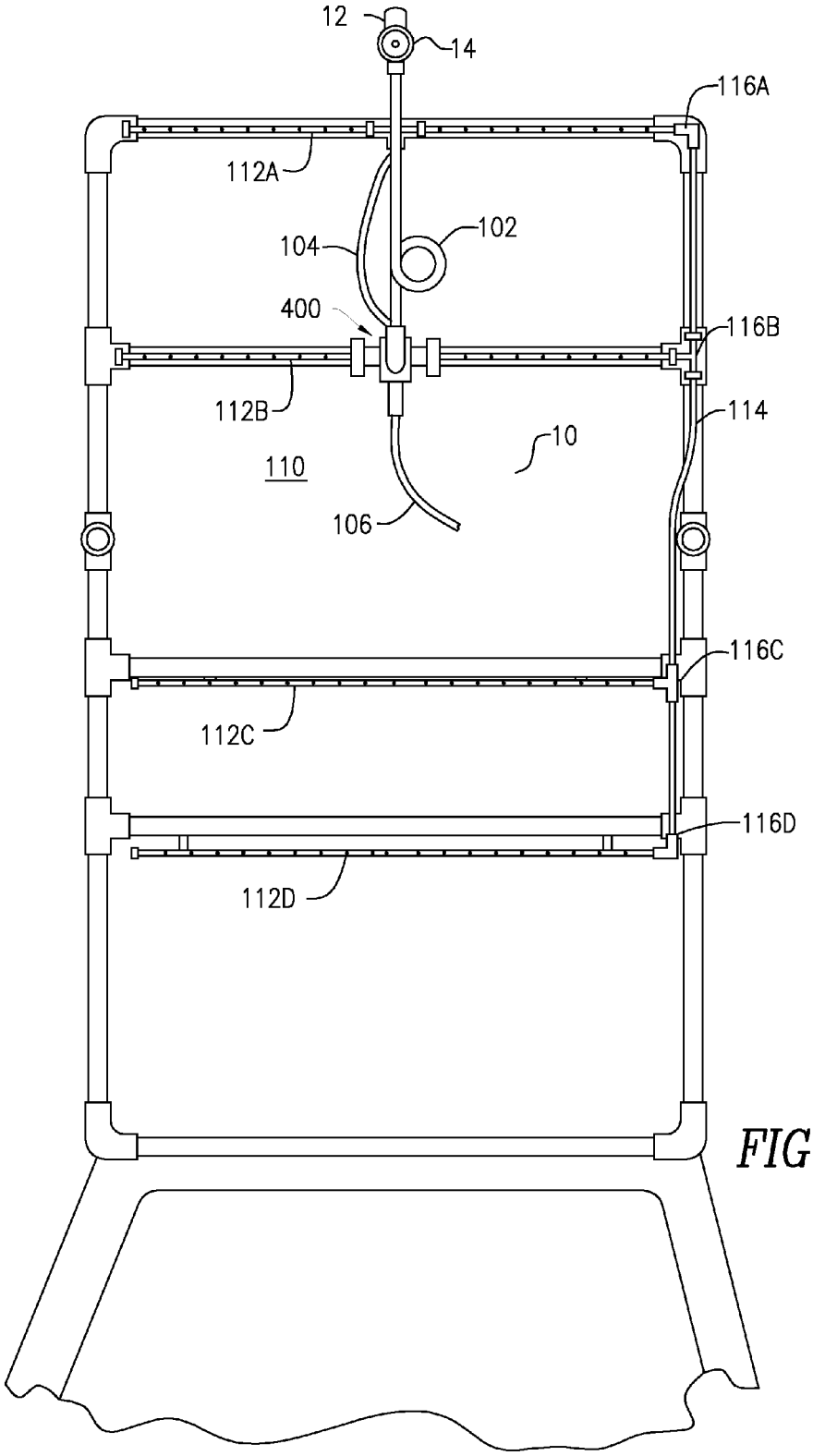
FIG. 2 is an elevational view of a first array of spray tubing for placement proximate to a first wall of the shower enclosure in accordance with one or more embodiments of the present invention.

With reference to FIG. 2, the first array 110 includes a plurality of laterally extending, and vertically spaced apart, spray tubes 112, such as spray tubes 112A, 112B, 112C, 112D. Although four spray tubes 112 are desirable due to the efficient balance of spray coverage versus required water pressure and flow, any number of spray tubes 112 may be employed without departing from the desired coverage of the invention. Each spray tube 112 includes a length sufficient to span at least a portion of the first wall 10, although it is preferred that the length be sufficient to span substantially an entire lateral dimension of the first wall 10.

A vertically oriented distribution tube 114 is coupled to one end of each of the four laterally extending spray tubes 112, where each of the spray tubes 112 is terminated at an opposite end thereof. The connections between the vertically oriented distribution tube 114 and each of the laterally extending spray tubes 112 may be accomplished using appropriate fittings known in the art. By way of example, the upper-most spray tube 112A may be coupled to the vertically oriented distribution tube 114 by way of an elbow fitting 116A; the next lower spray tubes 112B, 112C may be coupled to the vertically oriented distribution tube 114 by way of respective T-fittings 116B, 116C; and the lower-most spray tube 112D may be coupled to the vertically oriented distribution tube 114 by way of another elbow fitting 116D. In a preferred embodiment, the vertically oriented distribution tube 114 is located in a corner of the shower enclosure where the first and second walls 10, 20 come together in order to reduce the mechanical structure located at an entrance of the shower enclosure.

Figure 4:
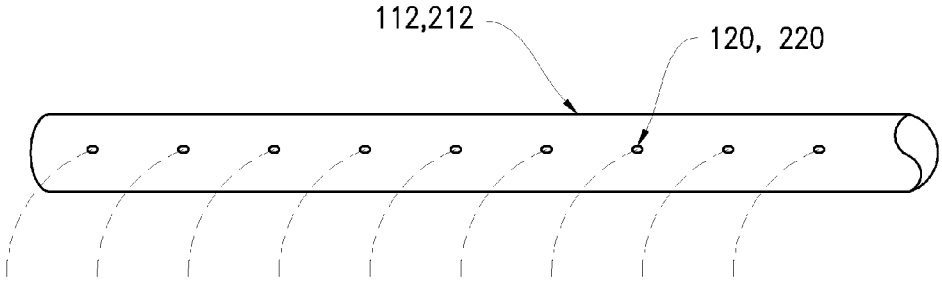
FIG. 4 is a schematic view of the details of a portion of a spray tube in accordance with one or more embodiments of the present invention.

As best seen in FIG. 4, each spray tube 112 includes a series of apertures 120 extending through a wall of the given tube 112 and permitting water to exit the tube 112 and spray into the shower enclosure. The size and number of the apertures 120 may vary from embodiment to embodiment; however, the size and number should be chosen based on a number of factors, including: the available water pressure and flow rate from the water feed 12, the relative sizes of the tubing interconnecting the first array 110 to the water feed 12, the desired pressure and flow rate at each aperture 120, and of course the water drawn by the existence of the second array 210. It has been found that for relatively common residential water pressure and flow rates in a typical shower enclosure, an aperture size of between about 1/32 to 1/16 inches and a pitch of about 1 aperture per inch along each spray tube 112 yields a satisfactory result.

Figure 3:
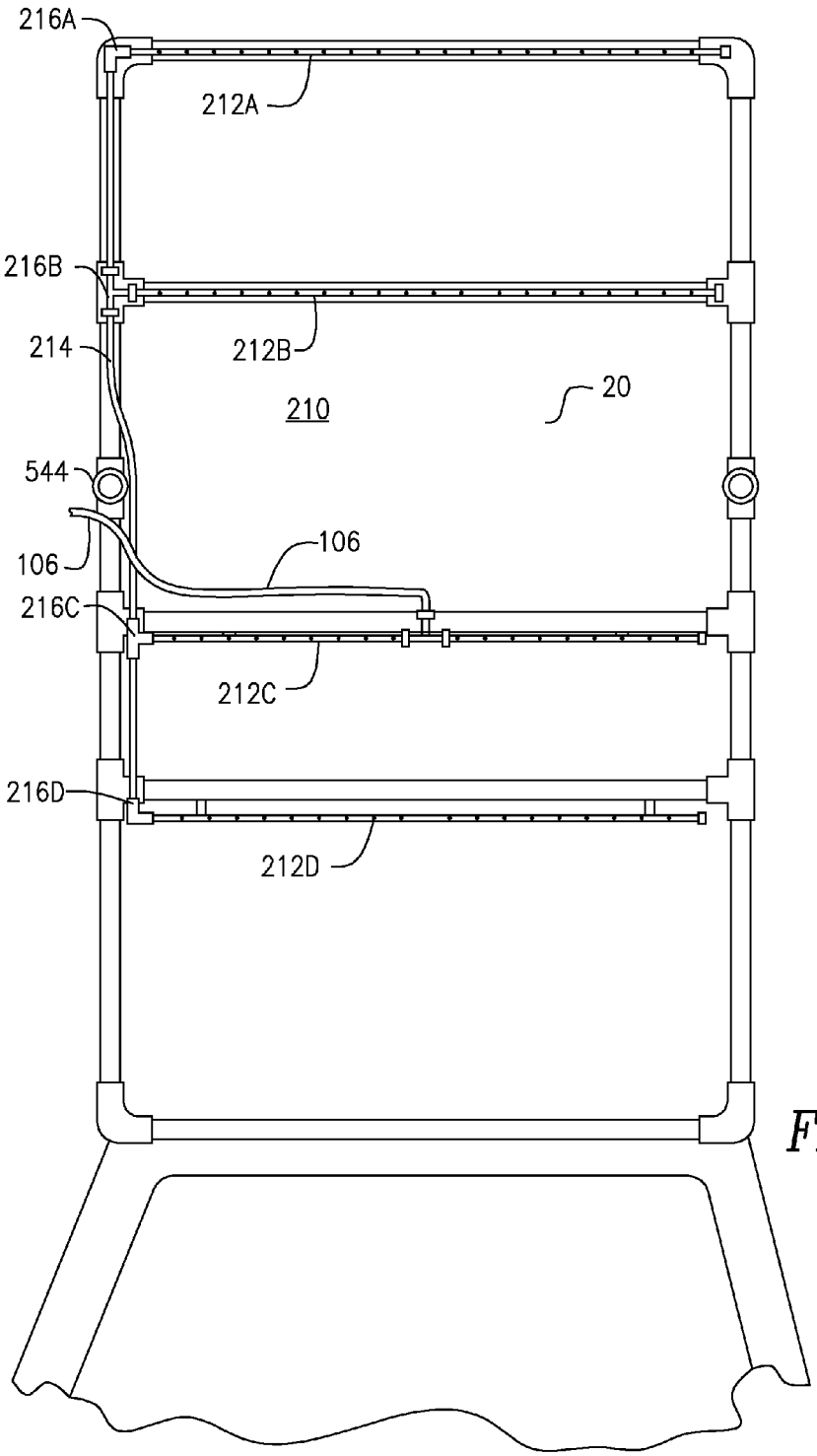
FIG. 3 is an elevational view of a second array of spray tubing for placement proximate to a third wall (opposite to the first wall) of the shower enclosure in accordance with one or more embodiments of the present invention.

With reference to FIG. 3, the second array 210 includes a plurality of laterally extending, and vertically spaced apart, spray tubes 212, such as spray tubes 212A, 212B, 212C, 212D. Although four spray tubes 212 are desirable due to the efficient balance of spray coverage versus required water pressure and flow, any number of spray tubes 212 may be employed without departing from the desired coverage of the invention. Each spray tube 212 includes a length sufficient to span at least a portion of the third wall 30, although it is preferred that the length be sufficient to span substantially an entire lateral dimension of the third wall 30.

A vertically oriented distribution tube 214 is coupled to one end of each of the four laterally extending spray tubes 212, where each of the spray tubes 212 is terminated at an opposite end thereof. The connections between the vertically oriented distribution tube 214 and each of the laterally extending spray tubes 212 may be accomplished using appropriate fittings known in the art. By way of example, the upper-most spray tube 212A may be coupled to the vertically oriented distribution tube 214 by way of an elbow fitting 116A; the next lower spray tubes 212B, 212C may be coupled to the vertically oriented distribution tube 214 by way of respective T-fittings 216B, 216C; and the lower-most spray tube 212D may be coupled to the vertically oriented distribution tube 214 by way of another elbow fitting 216D. In a preferred embodiment, the vertically oriented distribution tube 214 is located in a corner of the shower enclosure where the second and third walls 20, 30 come together in order to reduce the mechanical structure located at an entrance of the shower enclosure.

Similar to the first array 110, and with reference to FIG. 4, each spray tube 212 of the second array 210 includes a series of apertures 220 extending through a wall of the given tube 212 and permitting water to exit the tube 212 and spray into the shower enclosure. Preferably the spray tubes 112 of the first array 110 and the spray tubes 212 of the second array 210 are disposed such that the water spraying from the respective apertures 120, 220 are directed toward a user, who would be showering within the enclosure. As with the first array 110, the size and number of the apertures 220 of the second array 210 may vary from embodiment to embodiment; however, the size and number should be chosen based on the available water pressure and flow rate from the water feed 12, the relative sizes of the tubing interconnecting the second array 110 to the water feed 12, the desired pressure and flow rate at each aperture 220, and of the water drawn by the existence of the first array 110. Again, an aperture size of between about 1/32 to 1/16 inches and a pitch of about 1 aperture per inch along each spray tube 212 yields a satisfactory result.

Figure 5:
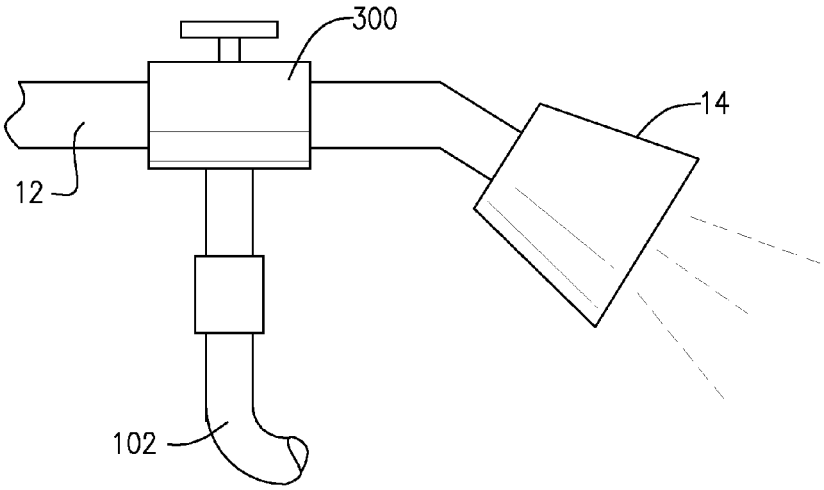
FIG. 5 is a schematic view of the details of a source valve in accordance with one or more embodiments of the present invention.

With reference to FIGS. 1 and 5, the system 100 preferably includes a source valve 300 for coupling to the water feed 12 and directing water to either: (i) a source tube 102, and/or (ii) an existing shower head 14 of the shower enclosure. The source valve 300 is preferably user activated such that the user may decide how much water is to be directed to the flexible source tube 102 and/or the existing shower head 14. Notably, in some embodiments the source valve 300 may have a simplified function, such as merely directing the water from the water feed to the source tube 102 without additional valve functions. The source tube 102 is preferably flexible in order to improve the retrofitting function into an existing shower enclosure and increasing the likelihood that a user may install the system 100 without requiring a specialist, such as a plumber or the like.

Figure 6:
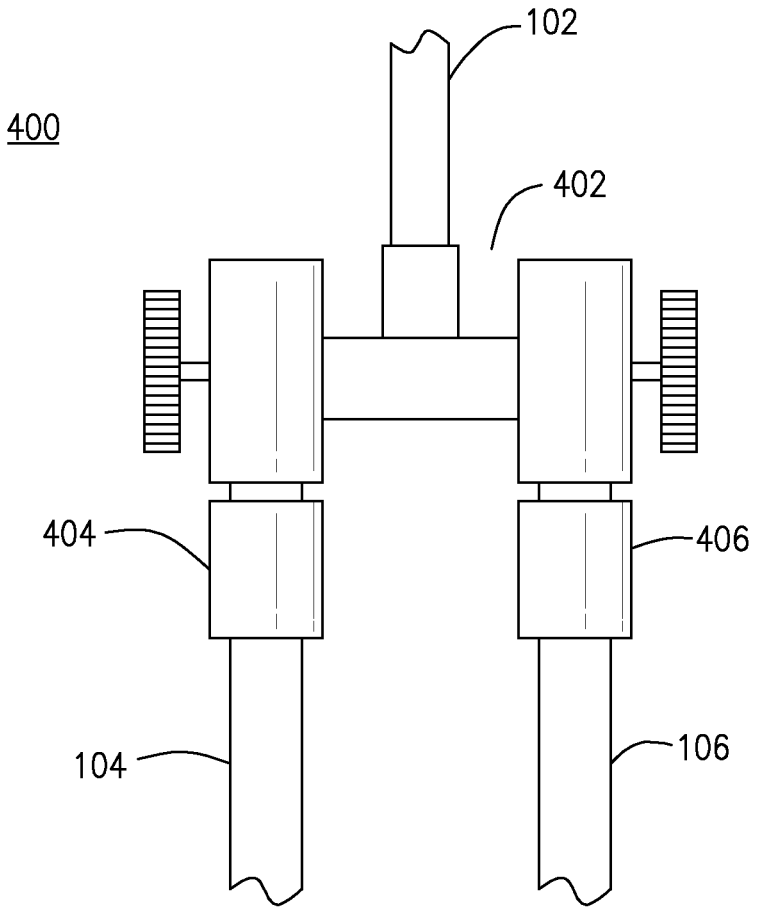
FIG. 6 is a schematic view of the details of a valve system in accordance with one or more embodiments of the present invention.

The flexible source tube 102 is coupled at one end to the source valve 300, and at an opposite end directly or indirectly to the first and second arrays 110, 210. In a preferred embodiment, the opposite end of the flexible source tube 102 is coupled to a valve system 400. With reference to FIGS. 2 and 6, the valve system 400 is operable to deliver water from the source tube 102 to the respective spray tubes 112, 212 of the first and second arrays 110, 210, in such a way as to adjust respective water flow rates to the first and second arrays 110, 210. For example, the valve system 400 may include an input port 402 and first and second output ports 404, 406, respectively. The input port 402 is coupled to, and receives water from, the flexible source tube 102. The first output port 404 is coupled to, and provides a user-variable flow of water to, a first intermediate source tube 104 that supplies water to the spray tubes 112 of the first array 110. The second output port 406 is coupled to, and provides a user variable flow of water to, a second intermediate source tube 106 that supplies water to the spray tubes 212 of the second array 210.

As best seen in FIG. 2, the first intermediate source tube 104 may be connected to one of: (i) the vertically oriented distribution tube 114 of the first array 110, and (ii) one of the spray tubes 112 of the first array 110. It has been found that satisfactory spray actions from the first array 110 is achieved when the first intermediate source tube 104 is connected mid-way along the length of an upper-most one of the laterally extending spray tubes 112A. As best seen in FIG. 3, the second intermediate source tube 106 may be connected to one of: (i) the vertically oriented distribution tube 214 of the second array 210, and (ii) one of the spray tubes 212 of the second array 210. It has been found that satisfactory spray actions from the second array 210 is achieved when the second intermediate source tube 106 is connected mid-way along the length of a lower one of the laterally extending spray tubes 212C.

In accordance with one or more further aspects of the present invention, the relative sizes of the tubing 102, 104, 106, 112, 114, 212, 214, especially inside diameters thereof, are taken into consideration in order to effect desirable spray action from the first and second arrays 110, 210. For example, the flexible source tube 102 may be characterized by an inside diameter, Ds; the first intermediate source tube 104 may be characterized by an inside diameter, D104; the second intermediate source tube 106 may be characterized by an inside diameter, D106; the distribution tube 114 may be characterized by an inside diameter, D114; the distribution tube 214 may be characterized by an inside diameter, D214; the spray tubes 112 may be characterized by an inside diameter of D112; and the spray tubes 212 may be characterized by an inside diameter of D212. In accordance with one or more embodiments the inside diameters of some or all of the above-listed tubing may be different. For example, in order to compensate for water pressure drops in the system 100, the inside diameter Ds of the flexible source tube 102 may be larger than at least the inside diameters of the spray tubes 112, 212. In one embodiment, the inside diameter Ds of the flexible source tube 102 may be about two times larger than the inside diameters of the spray tubes 112, 212. For example, the inside diameter Ds may be about ½ inch, while the inside diameters D112, D212 may be about ¼ inch. It has been found that the system 10 operates satisfactorily when Ds is about ½ inch, D104 is about ¼ inch, D106 is about ¼ inch, D114 is about ¼ inch, D112 is about ¼ inch, D214 is about ¼ inch, and D212 is about ¼ inch.

In accordance with one or more further embodiments, the system 100 further comprises a frame (FIG. 1) for supporting the first and second arrays 110, 210 within the shower enclosure. The frame preferably includes a first grid 502 of support arms for supporting the first array 110 of spray tubes 112; a second grid 504 of support arms for supporting the second array 210 of spray tubes 212, and an interconnecting structure 506 coupled between the first and second grids 502, 504. Preferably, the frame is formed from polyvinyl chloride pipe coupled together using polyvinyl chloride pipe fittings.

The first grid 502 preferably includes first and second, parallel and spaced apart, vertically extending posts 512, 514, and a plurality of laterally extending support arms 516A, 516B, 516C, 516D coupled to and extending between the first and second vertically extending posts 512, 514. An additional support arm 516E may be disposed between lower ends of the first and second vertically extending posts 512, 514 and provide support for the frame itself along an edge of a tub or shower pan of the enclosure. Each of the spray tubes 112A, 112B, 112C, 112D of the first array 110 is coupled to, and extends along, a respective one of the laterally extending support arms 516A, 516B, 516C, 516D of the first grid 502.

The components of the second grid 504 are substantially similar to the components of the first grid 502, and therefore will not be repeated here.

The interconnecting structure 506 preferably includes an interconnecting rod coupled at one end to an intermediate position along one of the vertically extending posts 512, 514 of the first grid 502, and coupled at an opposing end to an intermediate position along one of the vertically extending posts of the second grid 504. By way of example, each of the vertically extending posts 512, 514 of the first grid 502 may include a T-fitting 522, 524, respectively, that is sized to receive the one end of the interconnecting rod 506. Similarly, each of the vertically extending posts of the second grid 504 may include a T-fitting 542, 544, respectively, that is sized to receive the opposing end of the interconnecting rod 506. Thus, the interconnecting rod 506 may be coupled at the one end to either of the vertically extending posts 512, 514 of the first grid 502 and may be coupled at the opposing end to either of the vertically extending posts of the second grid 504, wherein the selection may be made by the user during installation of the frame into the shower enclosure.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An apparatus for installation into an existing shower enclosure, the shower enclosure including a first wall through which a water feed extends, a second wall, and third wall opposite the first wall, thereby forming the enclosure, the apparatus comprising:

a flexible source tube operating to couple to the water feed, the source tube having an inside diameter, Ds;

a first array for placement proximate to the first wall, and a second array for placement proximate to the third wall, opposite to the first array, each of the first and second arrays having at least two laterally extending, and vertically spaced apart, spray tubes, each spray tube having: (i) a length sufficient to span substantially an entire lateral dimension of the respective first or third wall at which they are disposed, (ii) a series of apertures extending through a wall of the given tube and permitting water to exit the tube and spray into the shower enclosure, and (iii) an inside diameter Di; and a valve system operable to deliver water from the source tube to the respective spray tubes of the first and second arrays, the valve system being operable to adjust respective water flow rates to the first and second arrays, wherein the inside diameter Ds of the flexible source tube is larger than either of the inside diameters Di of the spray tubes of the first and second arrays.

2. The apparatus of claim 1, further comprising a source valve for coupling to the water feed and directing water to either the flexible source tube or to an existing shower head of the shower enclosure in accordance with user selection.

3. The apparatus of claim 1, wherein:

the valve system includes an input port and first and second output ports;

the input port is coupled to, and receives water from, the flexible source tube;

the first output port is coupled to, and provides a user-variable flow of water to, a first intermediate source tube that supplies water to the spray tubes of the first array; and the second output port is coupled to, and provides a user variable flow of water to, a second intermediate source tube that supplies water to the spray tubes of the second array.

4. The apparatus of claim 3, wherein at least one of:

the inside diameter Ds is about two times larger than the inside diameters Di of at least one of the spray tubes of the first and second arrays;

the inside diameter Di of the spray tubes of the first and second arrays are substantially equal;

inside diameters of the first and second intermediate source tubes are substantially the same as the inside diameters Di of the spray tubes of the first and second arrays.

5. The apparatus of claim 3, wherein the first array includes:

at least four laterally extending, and vertically spaced apart, spray tubes; and a vertically oriented distribution tube coupled to one end of each of the four laterally extending spray tubes, each of the spray tubes being terminated at an opposite end thereof, wherein the first intermediate source tube is connected to one of the four spray tubes of the first array.

6. The apparatus of claim 5, wherein at least one of:

the first intermediate source tube is connected to an upper-most one of the four spray tubes of the first array; and the first intermediate source tube is connected mid-way along the length of the upper-most one of the four spray tubes.

7. The apparatus of claim 5, wherein the second array includes:

at least four laterally extending, and vertically spaced apart, spray tubes; and a vertically oriented distribution tube coupled to one end of each of the four laterally extending spray tubes, each of the spray tubes being terminated at an opposite end thereof, wherein the second intermediate source tube is connected to one of the four spray tubes of the second array.

8. The apparatus of claim 7, wherein at least one of:

the second intermediate source tube is connected to a lower one of the four spray tubes of the second array; and the second intermediate source tube is connected mid-way along the length of the lower one of the four spray tubes.

9. The apparatus of claim 1, further comprising a frame for supporting the first and second arrays within the shower enclosure, the frame comprising:

a first grid of support arms for supporting the first array of spray tubes; and a second grid of support arms for supporting the second array of spray tubes; and an interconnecting structure coupled between the first and second grids.

10. The apparatus of claim 9, wherein the first grid comprises:

first and second, parallel and spaced apart, vertically extending posts; and a plurality of laterally extending support arms coupled to and extending between the first and second vertically extending posts, wherein each of the spray tubes of the first array is coupled to and extends along a respective one of the laterally extending support arms of the first grid.

11. The apparatus of claim 10, wherein the second grid comprises:

first and second, parallel and spaced apart, vertically extending posts; and a plurality of laterally extending support arms coupled to and extending between the first and second vertically extending posts, wherein each of the spray tubes of the second array is coupled to and extends along a respective one of the laterally extending support arms of the second grid.

12. The apparatus of claim 11, wherein the interconnecting structure includes an interconnecting rod coupled at one end to an intermediate position along one of the vertically extending posts of the first grid, and coupled at an opposing end to an intermediate position along one of the vertically extending posts of the second grid.

13. The apparatus of claim 12, wherein:

the interconnecting rod may be coupled at the one end to either of the vertically extending posts of the first grid selected by the user during installation of the frame into the shower enclosure; and the interconnecting rod may be coupled at the opposing end to either of the vertically extending posts of the second grid selected by the user during installation of the frame into the shower enclosure.

14. The apparatus of claim 9, wherein the support arms of the frame are formed from polyvinyl chloride pipe and the support arms are coupled together using polyvinyl chloride pipe fittings.

15. An apparatus for installation into an existing shower enclosure, the shower enclosure including a first wall through which a water feed extends, a second wall, and third wall opposite the first wall, thereby forming the enclosure, the apparatus comprising:

a flexible source tube operating to couple to the water feed;

a first array for placement proximate to the first wall, and a second array for placement proximate to the third wall, opposite to the first array, each of the first and second arrays having at least two laterally extending, and vertically spaced apart, spray tubes, each spray tube having: (i) a length spanning at least a portion of the entire lateral dimension of the respective first or third wall at which they are disposed, and (ii) a series of apertures extending through a wall of the given tube and permitting water to exit the tube and spray into the shower enclosure;

a water distribution system operable to deliver water from the source tube to the respective spray tubes of the first and second arrays; and a frame for supporting the first and second arrays within the shower enclosure, the frame comprising (i) a first grid of support arms for supporting the first array of spray tubes, and a second grid of support arms for supporting the second array of spray tubes and (ii) an interconnecting structure coupled between the first and second grids.

16. The apparatus of claim 15, wherein:

the water distribution system includes an input port and first and second output ports;

the input port is coupled to, and receives water from, the flexible source tube;

the first output port is coupled to, and provides water to, a first intermediate source tube that supplies water to the spray tubes of the first array; and the second output port is coupled to, and provides water to, a second intermediate source tube that supplies water to the spray tubes of the second array.

17. The apparatus of claim 16, wherein the first array includes:

a vertically oriented distribution tube coupled to one end of each of the laterally extending spray tubes, each of the spray tubes being terminated at an opposite end thereof, wherein the first intermediate source tube is connected to one of: (i) the vertically oriented distribution tube of the first array, and (ii) one of the spray tubes of the first array.

18. The apparatus of claim 17, wherein the first intermediate source tube is connected mid-way along the length of an upper-most one of the laterally extending spray tubes.

19. The apparatus of claim 16, wherein the second array includes:

a vertically oriented distribution tube coupled to one end of each of the laterally extending spray tubes, each of the spray tubes being terminated at an opposite end thereof, wherein the second intermediate source tube is connected to one of: (i) the vertically oriented distribution tube of the second array, and (ii) one of the spray tubes of the second array.

20. The apparatus of claim 19, wherein the second intermediate source tube is connected mid-way along the length of a lower one of the laterally extending spray tubes.

* * * * *